US009573048B2

(12) United States Patent
Masching et al.

(10) Patent No.: US 9,573,048 B2
(45) Date of Patent: Feb. 21, 2017

(54) SHUFFLE BOARD GAME APPARATUS AND METHOD

(71) Applicants: Kurt Masching, Breese, IL (US); Casey Jackson, Aviston, IL (US)

(72) Inventors: Kurt Masching, Breese, IL (US); Casey Jackson, Aviston, IL (US)

( * ) Notice: Subject to any disclaimer, the term of this patent is extended or adjusted under 35 U.S.C. 154(b) by 0 days.

(21) Appl. No.: 14/322,413

(22) Filed: Jul. 2, 2014

(65) Prior Publication Data

US 2015/0008644 A1 Jan. 8, 2015

Related U.S. Application Data

(60) Provisional application No. 61/842,013, filed on Jul. 2, 2013.

(51) Int. Cl.
*A63F 7/00* (2006.01)

(52) U.S. Cl.
CPC ..... *A63F 7/0005* (2013.01); *A63F 7/0023* (2013.01); *A63F 2007/0041* (2013.01)

(58) Field of Classification Search
CPC .. A63F 7/0005; A63F 7/40; A63F 2007/4068; A63B 7/0023; A63B 2007/0041
USPC ..... 273/126 R, 126 A, 108, 118 R, 127 R; D21/312, 321
See application file for complete search history.

(56) References Cited

U.S. PATENT DOCUMENTS 697,406 A * 4/1902 Hammack ..... 273/123 R
751,070 A * 2/1904 Goff ..... 273/123 R
2,954,978 A * 10/1960 Towle, Jr. ..... 273/126 R
3,174,752 A * 3/1965 Plentis ..... 273/126 R
3,219,349 A * 11/1965 Smith ..... 273/126 R
3,594,000 A * 7/1971 Glass et al. ..... 273/108
3,807,738 A * 4/1974 Breslow ..... 273/126 R
3,825,264 A * 7/1974 Dockum ..... 273/126 R
4,215,863 A * 8/1980 Kuiper ..... 273/126 R
4,348,026 A * 9/1982 Kauffmann ..... 273/126 R
D273,311 S * 4/1984 Yoshimura et al. ..... D21/312
4,502,686 A * 3/1985 Iiams, Jr. ..... 273/126 R
4,513,967 A * 4/1985 Halford et al. ..... 273/108
4,563,008 A * 1/1986 Fielden ..... 273/126 R
5,556,093 A * 9/1996 Lankiewicz et al. ..... 273/126 A
D472,584 S * 4/2003 Perry ..... D21/321
8,434,762 B1 * 5/2013 Kerpovich ..... 273/126 A
2007/0075486 A1 * 4/2007 Silva ..... 273/126 R
2007/0075487 A1 * 4/2007 Silva ..... 273/126 R
2007/0257428 A1 * 11/2007 Silva et al. ..... 273/108
2011/0031685 A1 * 2/2011 Jude ..... 273/126 R
2012/0235353 A1 * 9/2012 Chambless, III ..... 273/126 R
2015/0008643 A1 * 1/2015 Stites et al. ..... 273/126 R
2015/0008644 A1 * 1/2015 Masching et al. ..... 273/126 R

* cited by examiner

*Primary Examiner* — Raleigh W Chiu
(74) *Attorney, Agent, or Firm* — Husch Blackwell LLP

(57) ABSTRACT

A shuffle board game system includes a shuffle board game apparatus and a method of playing a game. The board game apparatus includes a base, a symmetrical, enclosed, cross-configured shuffle board with a target pattern at the center with multiple playing pieces that can be distributed from each of the four ramps surrounding the board. The method of playing includes each of four players strategically launching their respective playing pieces from a ramp toward the target pattern or to block another player's ramp. Each player seeks to gain the most points based upon the proximity of their playing pieces to spaces within the target pattern.

6 Claims, 3 Drawing Sheets

Section A-A

Section B-B

SHUFFLE BOARD GAME APPARATUS AND METHOD

CROSS-REFERENCE TO RELATED APPLICATIONS

The application claims the benefit of U.S. Provisional Application No. 61/842,013, filed Jul. 2, 2013, and which is herein incorporated by reference.

TECHNICAL FIELD OF THE INVENTION

The present invention is directed to game systems and more particularly to shuffle board game systems including a shuffle board game apparatus and a method of playing a game.

BACKGROUND OF THE INVENTION

Prior art shuffle board games involve an elongated playing field and a plurality of game pieces such as a puck or a chip which may be slid along the surface of the playing field. The elongated playing field has at one end a launching region for a player to launch or shoot a play piece along the length of the playing field. The elongated playing field has at the other end a goal region having one or more goals for the playing piece. The player's score is determined by the placement of playing pieces on appropriate locations in the goal region. The goal region may include a target area having differential point values or one or more individual goals. The playing field and the goal region may be barrier free or may have one or more barriers which may assist or interfere with the players efforts to launch a playing piece into an intended location in the goal area.

Such shuffle board games have been popular for generations and have been made in many different sizes. They may have large playing fields including a launch area where a player may stand to launch a playing piece towards a goal. Alternatively, the playing field may be on an arcade game table or may be on a portable apparatus for home use. Still other shuffle board game systems have utilized electronic systems and a virtual playing field.

The present invention offers a novel shuffle board game apparatus and method offering improved portability and enjoyment.

BRIEF SUMMARY OF DISCLOSURE

The present invention provides a shuffle board game system including a shuffle board game apparatus and a method of playing a game that may be used with the shuffle board game apparatus.

In one exemplary embodiment, the shuffle board game apparatus is disclosed including a base stand that supports a cross-shaped side-enclosed platform with a target pattern at the center with multiple playing pieces that can be distributed from each of four ramps connected to the board. A preferred embodiment discloses a cross-shaped platform. The platform can have other geometric shapes.

In another exemplary embodiment, a method of playing is applied to the game with playing pieces launched strategically from each ramp with the goal of gaining the most points over the opponent or adversarial team by the placement of particular spaces within the target pattern.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

The accompanying drawings form a part of the specification and are to be read in conjunction therewith, in which like reference numerals are employed to indicate like or similar parts in the various views.

Figure 1:
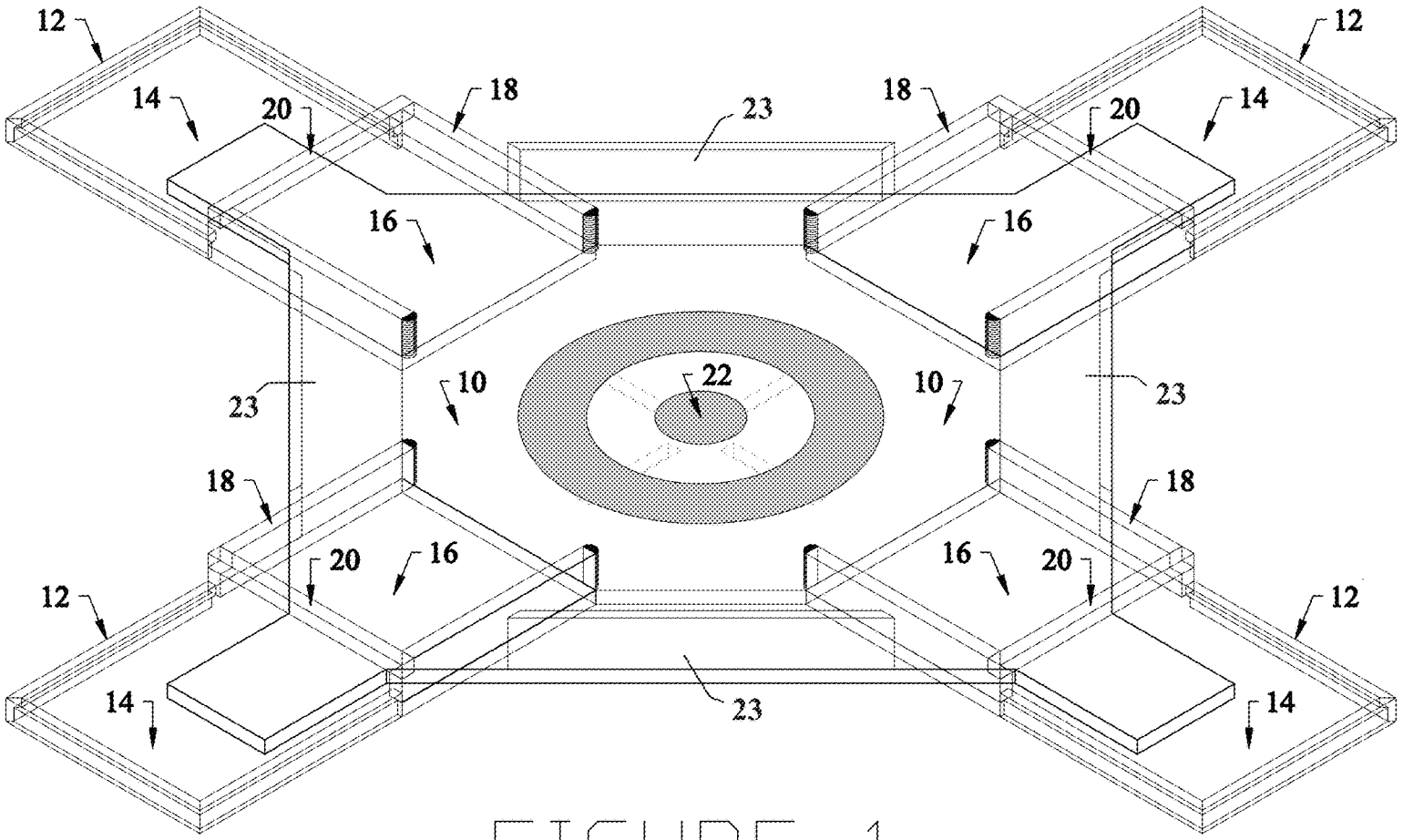
FIG. 1 is a perspective view of a shuffle board game according to a first embodiment of the present invention.

While the disclosure is susceptible to various modifications and alternative forms, specific embodiments thereof are shown by way of example in the drawings and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure as defined by the appended claims.

DETAILED DESCRIPTION

Figure 2:
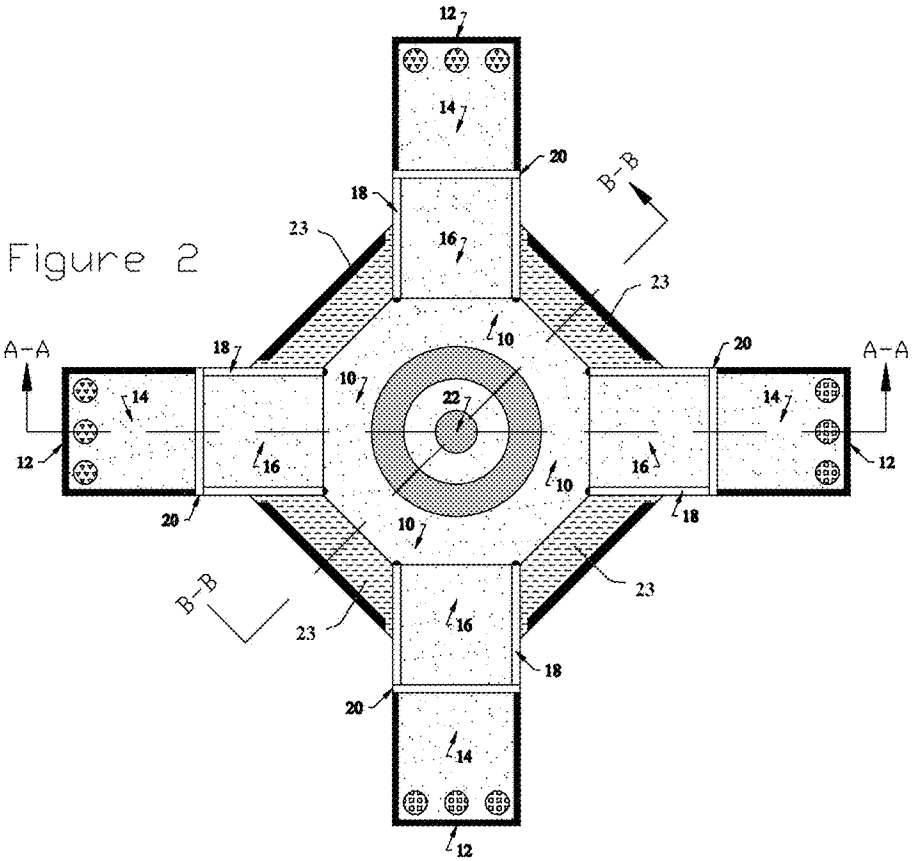
FIG. 2 is a plan view of a shuffle board game according to an embodiment.
Figure 3:
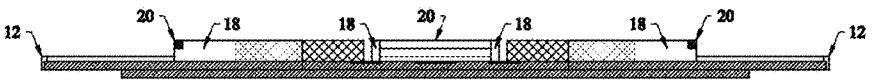
FIG. 3 is a cross sectional view of the shuffle board game of FIG. 2 taken along line A-A.
Figure 4:
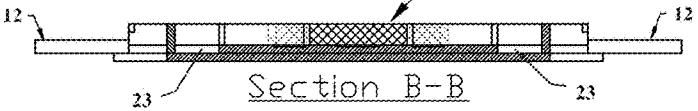
FIG. 4 is a cross sectional view of the shuffle board game of FIG. 2 taken along line B-B.
Figure 5:
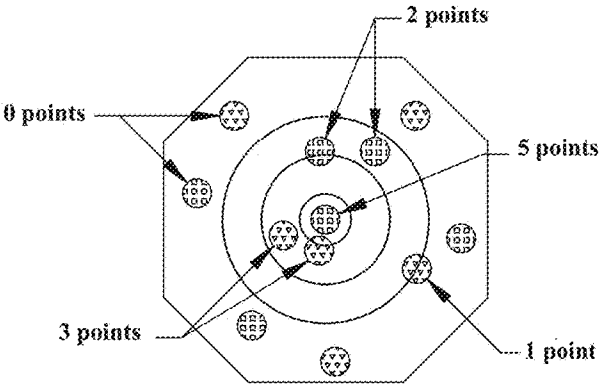
FIG. 5 is a top view of a board for a shuffle board game according to an embodiment illustrating an example of puck positioning and scoring.
Figure 6:
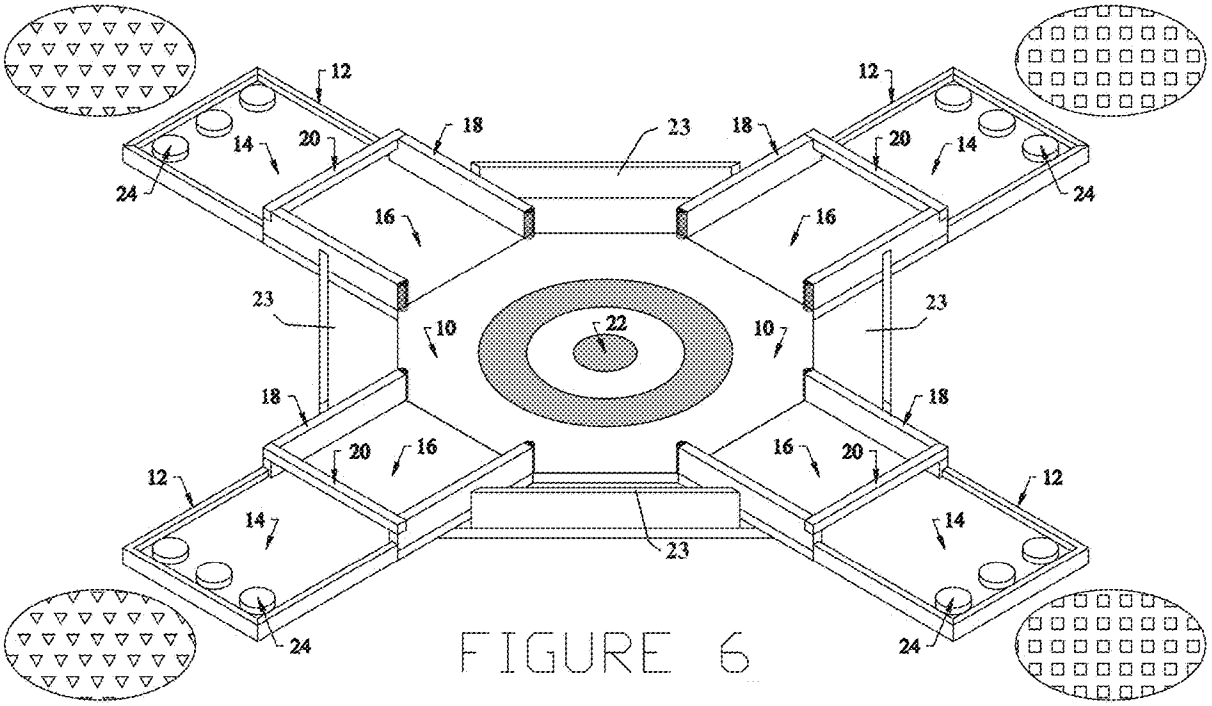
FIG. 6 is a perspective view of a shuffle board game illustrating the starting position of game and playing pieces.

An exemplary shuffle board game system including an exemplary shuffle board game apparatus is illustrated in FIGS. 1-6 and an exemplary game playing method is illustrated in FIGS. 2, 4, and 5. In the discussion that follows and also to the drawings, illustrative approaches to the disclosed systems and methods are shown in detail. Although the drawings represent possible approaches, the drawings are not necessarily to scale and certain features may be exaggerated, removed, or partially sectioned to better illustrate and explain the present invention. Further, the descriptions set forth herein are not intended to be exhaustive or otherwise limit or restrict the claims to the precise forms and configurations shown in the drawings and disclosed in the following detailed description.

Shuffle board games are typically played with playing pieces that are scaled for the size of the apparatus. The exemplary shuffle board game apparatus is a table top unit and the playing pieces are pucks. Pucks are also regularly referred to as "weights" or "shuckles" in the shuffle board industry. The shuffle board, pucks and stand may be formed from plastic, metal, ceramic, wood or other suitable material depending on such factors as cost, durability, weight and appearance.

The shuffle board, pucks and the stand may be solid colored, transparent or translucent or provided with ornamentation such as patterns, letters, numbers, logos, words, icons, or pictures. The ornamentation may include advertising. All of the pucks may be identical in size, color and shape or they may be varied for specific purposes. For example, pucks may be varied in size for different skill levels of players. Pucks may be varied in color or decoration for ornamental purposes. Pucks may be varied in ornamentation to distinguish between pucks for purposes of providing differential scoring values or for other purposes relating to the official rules of the game play or a method used by players for game play. Pucks may be varied in ornamentation to provide each player with uniquely decorated Pucks that may be identified with the player during game play. Similarly, the platform can be of any geometric design so long as players may face each to compete for the best location on the target pattern. For example, the platform can have a cross configuration, a star configuration, a triangular configuration. Moreover, the surface of the platform could be flat, convex, concave, or hilly.

It should be noted that the various components of the shuffle game apparatus, including base, walls, playing surface, pucks and brace may be constructed of wood, metal, plastic or any other suitable material depending on such factors as cost, durability, weight, surface characteristics and appearance. These components may be solid colored, transparent or translucent or provided with ornamentation such as patterns, letters, numbers, logos, words, icons, or pictures. The ornamentation may include advertising. Such ornamentation may be for decorative or advertising purposes. Alternatively, such ornamentation may be for a functional purpose such as providing rules, communicating reference points for aiming pucks, or to define regions or goals for differential scoring values or for other purposes relating to the official rules of the game play or a method used by players for game play, either alone or when used in combination with ornamentation on pucks. For example, the target may be provided numerals to show the amount of point that would correlate to a puck in the space.

The apparatus may be inexpensively mass produced in a home version for personal enjoyment, family leisure, and for friendly and quality time by people from all cultures and walks of life. Alternatively, it may be manufactured from prestige and durable materials for more upscale users. It may be manufactured in a heavier and more rugged version for use in bars, arcades and other commercial settings. It may be manufactured or ornamented in limited collector editions incorporating on its various surfaces advertisement, information, logos, family portraits, sports images, movie stars, famous places, flags of different clubs or nations, or sports teams. Thus, shuffle board game apparatus may be enjoyed by one or more people in the privacy of their homes, on ocean liners, or at armed force club, Boys and Girls clubs, resorts, bars, arcades or senior citizen housing. It is intended to be challenging and competitive.

An exemplary shuffle board apparatus according to the illustrated embodiment has a cross-shaped board 10 that is enclosed on most of its sides. Other geometric shapes are suitable for the board 10. The board 10 includes a plurality (four in the illustrated embodiment) of ramps 12 that extend away from the board 10. In the illustrated embodiment, the board 10 is essentially square with the ramps 12 being position at the corners of the square and oriented with their axes directed toward the center of the board 10. The ramps 12 are preferably constructed such that the inner ends of the ramps 12 have a surface at the same level as the surface of the board 10. The ramps 12 may be placed at a slight outwardly oriented incline relative to the horizontal surface of the board 10 or placed in the same horizontal plane of the board 10. In a preferred embodiment, the board 10 and ramps, or at least the upper surfaces thereof, are made of smooth wood that has been varnished or coated with polyurethane or other suitable material to produce a smooth, somewhat slick surface that facilitates sliding of the playing pieces along the surface. Other suitable materials include shuffleboard wax, or what is sometimes called shuffleboard powder, can be applied to enhance the speed of the playing pieces by reducing friction with the surfaces when sliding on the table. Shuffleboard wax or powder can include silicone ball bearings and/or silicone spray.

Each ramp is provided with first 14 and second 16 ends. The first 14 or outermost end is adjacent to the player during play and is where each player's remaining playing pieces are stored and from where the player begins to slide the pieces as described below. The second 16 or inner end is somewhat more enclosed than the first 14 in that it is provided with higher walls 18 and a cross bar 20. The cross bar 20 is intended to restrict how far a player may reach in sliding his or her playing pieces during play while allowing playing pieces to pass freely underneath. Together with the board, the second ends 16 of the four ramps 12 form what is referred to as the pit of the apparatus where most of the game action takes place.

As illustrated in FIGS. 1, 2, 4, and 6, a gutter 23 is provided between each of the ramps 12. As shown in FIG. 4, gutters 23 are in a lower horizontal plane than ramps 12 and board 10.

A target pattern 22 is placed onto the board 10 at the approximate center point of the board 10. In the illustrated embodiment, the target pattern 22 is in the form of a series of concentric circles. In the specific case of the illustrated embodiment, there are a series of three concentric circles that form the target pattern 22. Other geometric patterns may be used for the target pattern 22.

The playing pieces in the preferred embodiment are weighted pucks 24 having a smooth bottom surface to facilitate sliding and a colored upper surface to allow players to identify and distinguish their playing pieces from those of the other players on the board 10.

The apparatus may be provided with legs to raise the board 10 to a comfortable height for players to stand while playing. Alternately, the apparatus may be arranged to rest directly on a table top or counter. The table can also be built to accommodate a person sitting in a chair while playing—whereupon when the person is sitting the shuffle board is below the armpit of a person when the person is sitting with feet on the ground. A human person is anyone from two feet to seven feet in height. An ordinary human would include a child of two feet to an adult of seven feet. To accommodate play for an ordinary human person in a sitting position, the playing surface of the shuffle board can between a height of about one foot to about four feet from the ground, and more preferably of about two feet to about three feet from the ground.

There could be many different versions for game play. An exemplary method of playing the game begins with two teams, each consisting of two players for a total of four players. Players from each team sit across the table from each other, and diagonal to their teammate, or in other words, with their teammate by their side. Each player is provided with three playing pieces in accordance to his/her teams color. Play begins after one team is given the option to go first or second. The team deemed first thrower will choose one person to start, and he/she will be followed by the player on the opposite side of the table. Play then continues by alternating teams in the same order, with each player launching one puck per cycle. Each round will consist of three cycles.

Whichever team scores the most in a given round will start play for the next round alternating who throws first, unless the team who originally went first scores. The first launcher for each team will alternate throughout the game, as no player should start a round for his team twice in a row unless on a continuous scoring streak. If no team scores or there is a "push", the team that threw last will start the next round. Each game will be played as a race to 20, using the cancellation method score points.

Both teams will add up their points at the end of each round. The team with highest point total will be awarded the difference in points between the two teams' scores. Team must win by at least two (2) points or play will continue. All scoring is viewed by looking straight down over the puck. The following description of scoring is based upon the use of a target pattern having three concentric circles as discussed above and is one embodiment. As seen in FIG. 5, all pucks outside the outer ring of the target are worth zero (0) points. Any puck that breaks the outer ring, but does not completely enter the circle is worth one (1) point. Any puck that is completely inside the outer ring, but not completely into the second ring is worth two (2) points. Any puck that is completely inside the second ring, but not completely inside the center circle is worth three (3) points. A puck completely inside the center circle is worth five (5) points. Any puck that goes into a player's ramp area is fair game if it stays within the pit. This positioning of the puck can be used as a strategy to push pucks into the other team's areas, preventing them from scoring points. However, if a puck falls completely outside the pit, it may be removed from the playing surface.

In general with regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All defined terms used in the application are intended to be given their broadest reasonable constructions consistent with the definitions provided herein. All undefined terms used in the claims are intended to be given their broadest reasonable constructions consistent with their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

The invention claimed is:

1. A shuffle board game apparatus comprising:

a base;

a shuffle board having a horizontal surface, side portions, four corners and a target pattern located at the top center surface of the shuffle board;

four separate ramps each including a first outermost ramp portion having a first wall portion and a second inner ramp portion having a second wall portion, said second wall portion extending above the horizontal surface of the shuffle board and having higher walls than said first wall portion, each separate ramp extending away from one of the four corners of the shuffle board with its axes directed toward the center of the shuffle board, each of said four separate ramps being in the same horizontal plane as the shuffle board;

a cross bar that separates the first ramp portion and the second ramp portion of each of said separate ramps;

a gutter having inner and outer edges and being positioned and located between each pair of the separate ramps adjacent a side portion of the shuffle board, each gutter being defined by the respective second wall portions of each respective pair of ramps, a side portion of the shuffle board, and a third wall portion extending adjacent the outer edge of each gutter, each gutter being in a lower horizontal plane than the separate ramps and the shuffle board top center surface, the respective second wall portions of each respective pair of ramps defining each gutter forming an opening to each gutter; and at least one playing piece.

2. The shuffle board game apparatus of claim 1 wherein the shuffle board and the ramps are made of smooth wood; and wherein the shuffle board and the ramps are coated with a coating material that facilitates sliding of the playing pieces.

3. The shuffle board game apparatus of claim 2 wherein the coating material is polyurethane-based, silicon-based, or a combination thereof.

4. The shuffle board game apparatus of claim 2 wherein the coating material is shuffleboard wax.

5. The shuffle board game apparatus of claim 1 wherein the base is supported by legs.

6. The shuffle board game apparatus of claim 5 wherein the legs are adjustable to different lengths.

* * * * *